US005497535A

United States Patent [19]

Kloor

[11] Patent Number: 5,497,535

[45] Date of Patent: Mar. 12, 1996

[54] NON-BINDING ZIPPER

[76] Inventor: Patrick W. Kloor, 2F-7, Ohara 1-5-5, Setagaya-Ku, Tokyo 156, Japan

[21] Appl. No.: 254,883

[22] Filed: Jun. 6, 1994

[51] Int. Cl.[6] ..... A44B 19/00

[52] U.S. Cl. ..... 24/426; 24/427; 24/428

[58] Field of Search ..... 24/426, 427, 428, 24/429, 433, 435, 415

[56] References Cited

U.S. PATENT DOCUMENTS

| | | | |
|---|---|---|---|
| 2,855,652 | 10/1958 | Jones | 24/426 |
| 3,968,545 | 7/1976 | Kawashima | 24/426 |
| 3,973,300 | 8/1976 | Takamatsu et al. | 24/426 |
| 4,121,326 | 10/1978 | Kamiya | 24/426 |
| 4,261,082 | 4/1981 | Kamiya | 24/428 |
| 5,079,809 | 1/1992 | Teich et al. | 24/426 |

FOREIGN PATENT DOCUMENTS

| | | | |
|---|---|---|---|
| 0585212 | 10/1959 | Canada | 24/427 |
| 2220983 | 1/1990 | United Kingdom | 24/426 |

*Primary Examiner*—Victor N. Sakran
*Attorney, Agent, or Firm*—Arthur P. Gershman

[57] ABSTRACT

A zipper of the type having two tapes with interconnecting teeth, a slide having a front and rear and including a divider to separate and mesh the teeth in cooperation with a pull tab attached to the slide, includes spaced wing segments formed on the slide in proximity to the front of the slide. The spaced wing segments present a profile at the front or leading edge of the slide, in which the profile takes the form of a plow. The plow-like profile is formed as a beveled surface at the leading edge, and is thus adapted to force extraneous material such as threads, fabric, and the like, away from engagement with the interconnecting teeth when the zipper is zipped to the zipped-up condition. The trailing edge, or rear, of the slide may similarly be beveled to exclude unwanted fabric when the zipper is unzipped.

In an additional embodiment a bead or ridge or land is provided on the tapes running parallel with the central longitudinal axis of the tapes to provide an additional means for preventing engagement of extraneous material in the teeth.

15 Claims, 3 Drawing Sheets

NON-BINDING ZIPPER

The present invention relates to the slide fasteners known commonly as "zippers," and more particularly to such a slide fastener having means for the prevention of binding the material to be zipped together as the slide fastener is zipped up.

BACKGROUND OF THE INVENTION

Since the invention of the zipper 100 years ago numerous efforts have been made to improve on the basic design for the purpose of overcoming various problems which have been encountered in its use. One of the most persistent of these problems is the binding of excess material or a stray thread between the teeth of the zipper when the fastener is zipped up, causing the zipper to freeze and perhaps even ripping the bound material.

U.S. Pat. No. 5,079,809 to Teich et al., dated 1992, is directed to an anti-binding zipper slider. According to Teich et al extended side wing segments having tapered edges are provided to deflect the edges of the garment when the slide of the slide fastener is in operation. While the invention of Teich recognizes the problem of the prior art, the proposed solution fails to address the principal reason for the unwanted binding of fabric, namely, that the leading edge of the slide acts as a scoop to draw the fabric inwardly as the fastener is moved on the fabric tapes.

SUMMARY AND OBJECTS OF THE INVENTION

Accordingly, it is the primary object of the present invention to overcome the disadvantages of the prior art to provide a zipper which is so shaped and configured as to prevent the snagging of extraneous fibers or thread or other material in the zipper when it is utilized.

It is also an object of the present invention to provide such a zipper which is easy to operate, yet which prevents such snagging of the zipper.

A further object of the present invention is the provision of such a zipper which is easy to manufacture.

An additional object of the invention is the provision of such a zipper by means which do not increase the cost of manufacture of the zipper.

Yet another object of the invention is to provide a zipper which overcomes the described disadvantages of the prior art zippers, yet which is economically constructed and operated.

A further object of the invention is to provide a zipper with a minimum number of parts, which is labor-saving in operation, and which is sufficiently simple in design so as to be easy to operate and manufacture.

Still another object of the invention is the provision of such a zipper which is so constructed and manufactured as to reduce the chances of encountering difficulties in operation.

Yet another object of the invention is to provide a method of making such a zipper.

The above and other objects of the present invention which will become apparent hereinafter are achieved according to the invention by the provision of a zipper of the type having two tapes with interconnecting teeth, a slide having a front and rear and including a divider to separate and mesh the teeth in cooperation with a pull tab attached to the slide. The zipper includes spaced wing segments formed on the slide in proximity to the front of the slide. The spaced wing segments present a profile at the front or leading edge of the slide, in which the profile takes the form of a plow. The plow-like profile is formed as a beveled surface at the leading edge, and is thus adapted to force extraneous material such as threads, fabric, and the like, away from engagement with the interconnecting teeth when the zipper is zipped to the zipped-up condition. The trailing edge, or rear, of the slide may similarly be beveled to exclude unwanted fabric when the zipper is unzipped.

In an additional embodiment a bead or ridge or land is provided on the tapes running parallel with the central longitudinal axis of the tapes to provide an additional means for preventing engagement of extraneous material in the teeth.

These and other features, objects and advantages of the invention will become apparent upon consideration of the following detailed description wherein preferred embodiments of the invention are illustrated and described and the drawings in which:

DESCRIPTION OF THE PREFERRED EMBODIMENTS

Basic System Elements

Figure 3:
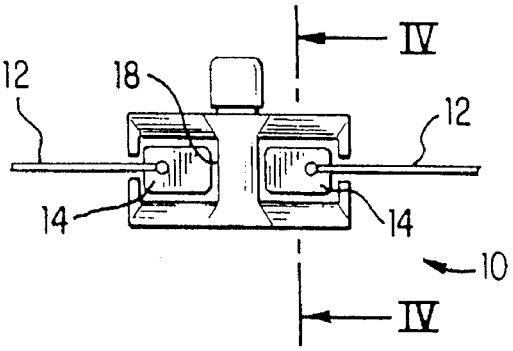
FIG. 3 is a front view of the embodiment of the zipper in accordance with the invention as shown in FIG. 2, illustrating the plow-like form of the leading edge of the slide, in accordance with the invention.

Referring now in detail to the drawings, there is illustrated in FIG. 3 a first embodiment of a zipper apparatus in accordance with the present invention, designated generally by reference numeral 10. Zipper 10 is essentially of a type of slide fastener well known in the art, having two tapes 12, each of which carries a row of opposed and mating teeth 14, a slide 16, including a divider 18 (see FIG. 3) to separate the teeth, and a pull tab 20 (see FIG. 4) attached to a retainer bar 22, but which is modified in accordance with the invention in a manner which will be explained in detail hereinafter. Tape 12, carrying teeth 14, and slider 16, are symmetrically arranged with respect to the central longitudinal axis C—C of the zipper 10.

Figure 1:
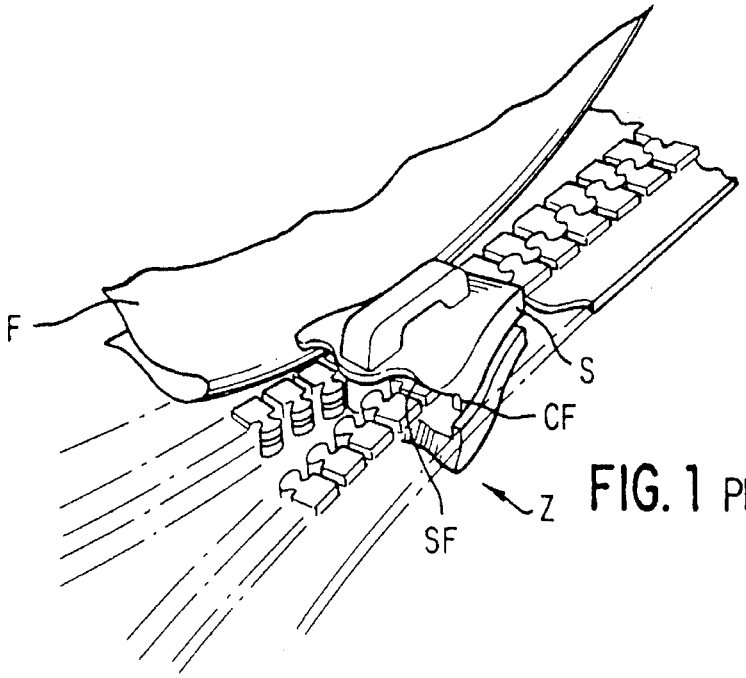
FIG. 1 PRIOR ART
FIG. 1 is a perspective view of a prior art slide fastener apparatus, illustrating the problem of the prior art in which extraneous fabric becomes enmeshed in the zipper when the zipper is in operation.

Referring now to FIG. 1, a conventional zipper is therein illustrated in order to illuminate the problems of the prior art. The conventional zipper Z has a slide S, with a conventional front SF, which is so shaped that it may actually act as a scoop to draw in stray threads or fabric F which lies across the path of the zipper as it is zipped up. Further, front SF of conventional zipper Z forms a pair of corners CF, each of which provides a surface which is particularly adapted to snag stray threads or fabric, at the point where the corners CF most closely approach the teeth over which the slide passes as the zipper is zipped up.

Figure 2:
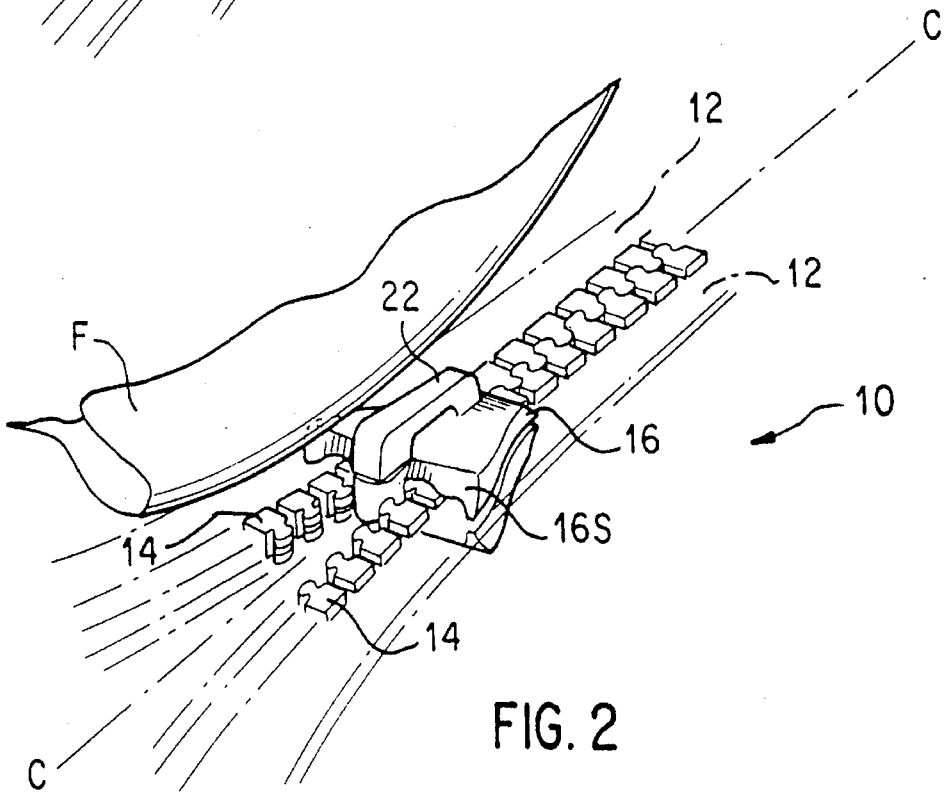
FIG. 2 is a perspective view of the slide fastener apparatus of FIG. 1 made in accordance with a first embodiment of the present invention, illustrating the manner in which extraneous fabric is excluded from becoming enmeshed in the zipper when the zipper is in operation.
Figure 4:
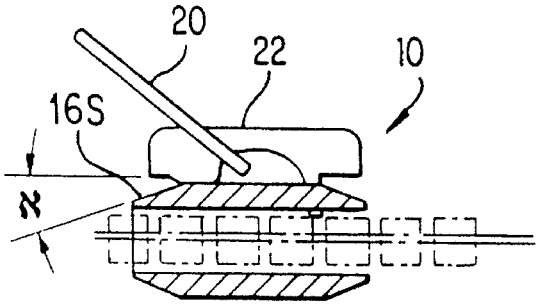
FIG. 4 is a sectional view, taken along line IV—IV of FIG. 3, further illustrating the apparatus made in accordance with the present invention.
Figure 5:
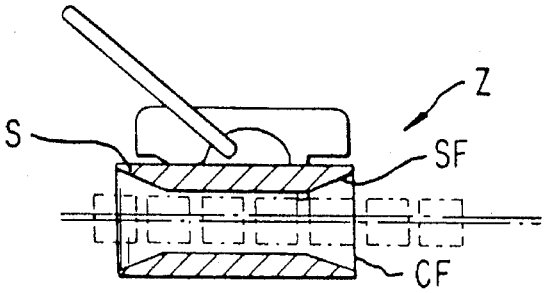
FIG. 5 PRIOR ART
FIG. 5 is a sectional view, similar to the view of FIG. 4, of the prior art zippers, further illustrating the differences between the prior art and the invention shown FIG. 4.

Referring now to FIG. 2 and FIG. 4, the inventive zipper 10 is illustrated having a slide 16, in which the leading edge or front of the zipper is provided with a surface 16S which presents an acute angle with respect to the plane generally defined by the extent of the tapes and teeth of the zipper. As illuminated by the drawing, and in contrast to the prior art zipper illustrated in FIGS. 1 and 5, surface 16S acts like a plow to lift any extraneous fabric F up and over the nip between the teeth of the slider 16, preventing the binding up of the zipper.

More particularly, as seen in FIG. 4, surface 16S is set at an angle ℵ (aleph) which is the designated angle which surface 16S makes with the above-defined tape-zipping plane. Angle ℵ (aleph) may be any acute angle which is consistent with the other principles of zipper design set forth herein or generally known in the art. For example, surface 16S may be alternatively a complex shape, a compound shape, etc., as long as angle ℵ is an acute angle at the point where stray threads, fabric or other extraneous material might be drawn by the zipper action into the nip of the teeth and slide or slider. Further, surface 16S may be so formed as to eliminate any corners at the forward surface of the slide, i.e. eliminating the conventional corners CF of the convention zipper Z, as described hereinabove in connection with FIG. 1.

Additional Embodiment and Features

Figure 6:
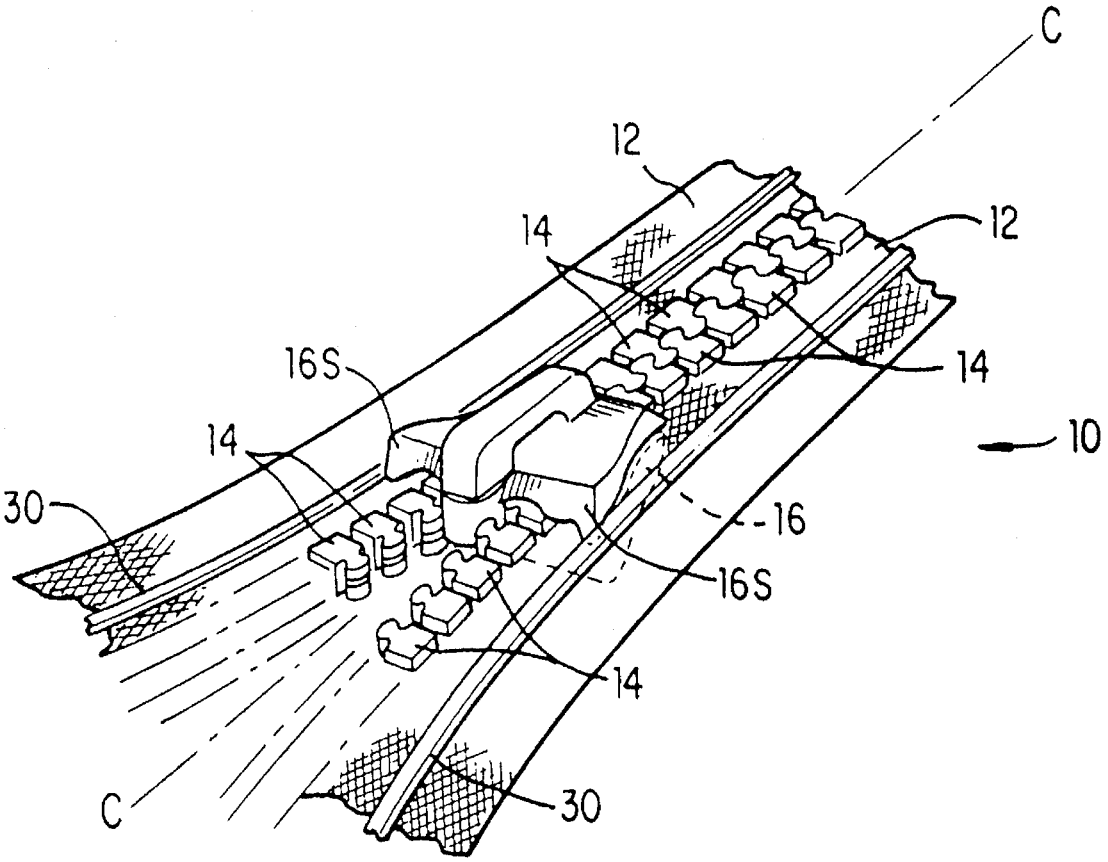
FIG. 6 is a perspective view illustrating an alternative embodiment of the invention, in which beads are provided on the zipper tapes running parallel to the central longitudinal axis of the zipper.

Referring now to FIG. 6, an additional embodiment is disclosed in which the tapes 12 are provided with beads or ridges or lands 30. Beads 30 run parallel to the central longitudinal axis C—C of the zipper 10, in the plane defined by the tape fabric itself. A bead 30 is provided on each side of slide 16, at close proximity to the farthest outside dimension of the width of the slide as close as possible to the slide, as illustrated in the accompanying FIG. 6. According to this arrangement, extraneous thread or fabric or other material is further prevented from coming in contact with and being drawn into the nip of the teeth 14 and the slide 16.

Beads 30 may be made of any material and formed in any fashion consistent with the principle of the invention and the zipper art, but in the preferred embodiment are small rubber strips or seals of rectangular cross-section which are firmly glued or cemented to the fabric tapes 12. The height of the beads is such that they extend substantially higher above the surface of the tapes than the teeth 14, providing an effective barrier to the entry of stray fabric or thread into the zipper. It is clear beads 30 may be made in a variety of forms, of various materials, and may be incorporated into the zipper in a variety of ways. It is noted that the slide may be formed with any shape, but that a shape having rectangular sides, to mate with beads 30, is particularly desirable.

For these reasons, inter alia, it will be appreciated that while preferred embodiments of the invention have been illustrated and described in detail herein, changes and additions may be had therein and thereto without departing from the spirit of the invention. Reference should, accordingly, be had to the appended claims in determining the true scope of the invention.

What is claimed is:

1. A slide fastener of the type having two tapes with interconnecting teeth thereon, a slide having a front and rear and including a divider to separate and mesh the teeth in cooperation with a pull tab attached to the slide, comprising:

spaced wing segments formed on said slide in proximity to the front of said slide;

said spaced wing segments presenting a profile at a leading edge of the front of said slide;

wherein said profile is beveled so as to form an angle of 90 degrees or less at the leading edge of said slide, wherein said slide is arranged symmetrically along a central longitudinal axis coinciding with a central longitudinal axis about which said two tapes are arranged; and bead means cooperating with said profile formed on said tapes running parallel with the central longitudinal axis of the slide located a predetermined distance from said central longitudinal axis of the slide on either side of said slide, whereby extraneous fabric material and thread is prevented from entering the mesh of the teeth of the slide fastener.

2. The device of claim 1 wherein said profile forms a surface having a predetermined shape.

3. The device of claim 2 wherein said predetermined shape of said surface is a simple planar surface.

4. The device of claim 2 wherein said predetermined shape of said surface is a compound surface having at least one planar surface.

5. The device of claim 2 wherein said predetermined shape of said surface is a compound surface having at least one non-planar surface.

6. The device of claim 2 wherein said predetermined shape of said surface is a compound surface having at least one curved surface.

7. The device of claim 2 wherein said predetermined shape of said surface is a compound surface having at least one non-planar surface.

8. A slide fastener as set forth in claim 1 wherein the spaced wing segments present a profile at a trailing edge of the rear of said slide;

wherein said profile is beveled so as to form an angle of 90 degrees or less at the trailing edge of the slide.

9. A slide fastener as set forth in claim 1 wherein the bead means are formed so as to have a rectangular cross-section.

10. A slide fastener as set forth in claim 9 wherein said slide has side surfaces extending between said front and rear of said slide, wherein said side surfaces present a rectangular cross-section, mating with the rectangular cross-section of the bead means.

11. A slide fastener as set forth in claim 1 wherein the bead means are formed so as to have a non-rectangular cross-section.

12. A slide fastener as set forth in claim 1 wherein said predetermined distance between said bead means and the respective tape edges is located so that the bead means is located in close proximity to the slide.

13. A slide fastener as set forth in claim 1 wherein said bead means are formed separately from said tapes and then adhered to said tapes.

14. A slide fastener as set forth in claim 1 wherein said bead means are formed integrally with said tapes.

15. A slide fastener as set forth in claim 1 wherein the bead means have a height such that the bead means extend substantially higher above the surface of the tapes than the teeth of the slide fastener.

* * * * *